US009656832B2

(12) United States Patent
Morgan et al.

(10) Patent No.: US 9,656,832 B2
(45) Date of Patent: May 23, 2017

(54) HOSE REEL REWIND SPEED CONTROL

(75) Inventors: Sean Morgan, Mentone (AU); Stuart Morgan, Moorabbin (AU)

(73) Assignee: REEL-TECH PTY. LTD., Mentone, Victoria (AU)

( * ) Notice: Subject to any disclaimer, the term of this patent is extended or adjusted under 35 U.S.C. 154(b) by 0 days.

(21) Appl. No.: 13/516,970

(22) PCT Filed: Dec. 17, 2010

(86) PCT No.: PCT/AU2010/001696

§ 371 (c)(1),
(2), (4) Date: Jun. 18, 2012

(87) PCT Pub. No.: WO2011/072337

PCT Pub. Date: Jun. 23, 2011

(65) Prior Publication Data

US 2012/0298784 A1 Nov. 29, 2012
US 2014/0117136 A2 May 1, 2014

(30) Foreign Application Priority Data

Dec. 17, 2009 (AU) ..... 2009906131

(51) Int. Cl.
*B65H 75/30* (2006.01)
*B65H 75/44* (2006.01)

(52) U.S. Cl.
CPC ..... *B65H 75/4447* (2013.01); *B65H 2701/33* (2013.01)

(58) Field of Classification Search
CPC ..... B65H 75/4447; B65H 2701/33
USPC ..... 242/381, 381.5, 381.6; 191/12.2 R, 12.4
See application file for complete search history.

(56) References Cited

U.S. PATENT DOCUMENTS 3,318,550 A * 5/1967 Quenot ..... 242/381.5
3,528,624 A * 9/1970 Tamarin ..... 242/385.1
3,587,474 A * 6/1971 Fuchs ..... B61B 11/004 104/173.2
3,596,849 A * 8/1971 Tamarin ..... 242/385.1
3,889,897 A * 6/1975 Van Zelderen ..... 242/381.5
4,227,661 A * 10/1980 King et al. ..... 242/385.2
4,456,195 A * 6/1984 Takada ..... B60R 22/405 242/381.5
4,485,278 A 11/1984 Schaller et al.
4,487,380 A * 12/1984 King ..... 242/381.5
5,083,633 A * 1/1992 Seeger ..... A62B 1/08 182/233

(Continued)

FOREIGN PATENT DOCUMENTS

DE 1110014 6/1961
DE 20221032 10/2004

(Continued)

OTHER PUBLICATIONS

PCT International Preliminary Report on Patentability, PCT/AU2010/001696 dated Jun. 19, 2012.

(Continued)

*Primary Examiner* — William A Rivera
(74) *Attorney, Agent, or Firm* — TraskBritt P.C.

(57) ABSTRACT

The invention is a centrifugal brake device that is a speed control means for spring motor hose and cable reels. This brake device is mounted to a shaft of a hub associated with the reel, such that the device controls the reel rotation speed.

7 Claims, 3 Drawing Sheets

(56) References Cited

U.S. PATENT DOCUMENTS

| | | | | |
|---|---|---|---|---|
| 5,630,249 | A * | 5/1997 | Rebai, Jr. | 16/78 |
| 6,318,665 | B1 * | 11/2001 | King | 242/385.1 |
| 7,077,246 | B2 | 7/2006 | Timtner | |
| 7,281,620 | B2 | 10/2007 | Wolner et al. | |
| 7,475,841 | B2 | 1/2009 | Fancher | |
| 8,167,090 | B2 * | 5/2012 | Michael | A62B 1/10 182/231 |
| 8,813,914 | B2 * | 8/2014 | Rinklake | A62B 1/10 182/234 |
| 2004/0262109 | A1 | 12/2004 | Timtner | |
| 2005/0051659 | A1 | 3/2005 | Wolner et al. | |
| 2008/0164361 | A1 | 7/2008 | Fancher | |
| 2009/0189005 | A1 | 7/2009 | Roman et al. | |
| 2012/0298784 | A1 * | 11/2012 | Morgan et al. | 242/381.5 |

FOREIGN PATENT DOCUMENTS

| | | | |
|---|---|---|---|
| DE | 202006018549 | | 5/2007 |
| SU | 469473 | * | 8/1975 |
| WO | 8201623 | A1 | 5/1982 |
| WO | 8202703 | A1 | 8/1982 |
| WO | 2005025678 | A1 | 3/2005 |
| WO | 2007113171 | A1 | 10/2007 |
| WO | 2011072337 | A1 | 6/2011 |

OTHER PUBLICATIONS

PCT International Search Report and Written Opinion, PCT/AU2010/001696 dated Feb. 23, 2011.

European Office Action for copending EP Application No. 10 836 848.1 dated Nov. 25, 2015.

* cited by examiner

HOSE REEL REWIND SPEED CONTROL

CROSS-REFERENCE TO RELATED APPLICATIONS

This application is a national phase entry under 35 U.S.C. §371 of International Patent Application PCT/AU2010/001696, filed Dec. 17, 2010, designating the United States of America and published in English as International Patent Publication WO 2011/072337 A1 on Jun. 23, 2011, which claims the benefit under Article 8 of the Patent Cooperation Treaty and under 35 U.S.C. §119(e) to Australian Patent Application Serial No. 2009906131, filed Dec. 17, 2009.

TECHNICAL FIELD

This disclosure relates to the area of reels for storing tubing of various types, including hoses and electrical cables and the like, and, in particular, to hose reels for all hose applications. This disclosure relates to an automatic hose and cable storage device that is provided with a rewind speed control means.

BACKGROUND

While the disclosure described herein relates in general to reels for storing all types of tubing for convenience sake, it will be discussed herein in terms of its application to hose reels.

Traditional mechanical hose reels, even for industrial applications, provided direct hand-cranked systems with bearings to assist in the rewind. These systems provided spools for housing the hose mounted on a frame supported between two axial bearing assemblies with a crank means located at one end.

To further assist in the rewinding procedure, hoses are frequently wound on spring-loaded reels, the arrangement being that the hose, when it is to be used, is drawn out from the reel against the action of a spring and fixed at any given length by a locking means of some type.

When the reel is to be rewound, the locking means is released and the spring acts to rotate the reel and rewind the hose.

Spring motor reels have also commonly been used in garages and other work shop environments, particularly in mining and heavy industry maintenance applications.

Once the reel is fully rewound, the spring will almost be in a relaxed state except for the smallest amount of tension to simply keep the hose fully wound to a stop point at the cable end.

There is an associated problem, however, in that the controlled rewind speed of the hose or cable is dependent on the operator maintaining control of the hose end and allowing for slow rewind of the hose by applying a resistance to the rewind process by keeping hold of the hose itself.

If the hose is accidentally released by the operator while still being mostly unwound, then it will rewind of its own accord in a most violent and rapid manner. It is in these circumstances that serious personal injury can occur to personnel near the reel or that damage can occur to the reel apparatus or other items in the vicinity of the reel and hose.

As a result, various attempts have been made to provide speed control devices for use in association with such reels.

Most of these are concerned with a viscous type device for speed control or use an air motor or hydraulic motor in a reverse fashion by applying a restriction to the outlet of these devices then, by coupling them to the rotary spool of the reel by some sprocket or gearing method, allowing either a controlled compression of a fluid or air, a controlled metering of fluid or air through an air motor or hydraulic motor, making it work in reverse as a vane compressor or a pump, whereby the resistance to flow at higher metered restricted flow volumes generated by the higher rotational speeds is translated to greater rotational resistance at these higher speeds in order to slow the rotation speed of the spool to a normalized speed.

These methods are expensive and complex and require maintenance and fine tuning, thus working against the original low-cost concept of the spring motor reel itself.

DISCLOSURE

Provided is an improved spring motor reel that avoids the limitations that the conventional reel designs described above have with respect to rewind spring control. In particular, provided is an improved braking system for a spring motor reel.

The disclosure is a rewind speed control means for spring motor hose and cable reels, which means utilizes a centrifugal brake device to control the reel rotation speed.

It is preferred that the reel concerned is a hose reel.

It is further preferred that the disclosure utilize a drum having generally the same dimensions as the spring motor itself.

It may also be preferred that the disclosure be provided as an integral unit being incorporated within one single drum assembly dimensioned to accommodate the speed control device along with the spring motor itself.

It is further preferred that the drum provide the stator, whereby a rotating disc rotor is coupled in line with the spring arbour and hub shaft and is contained within the drum stator.

It is preferred that the rotating disc or rotor be provided with at least one weighted shoe.

It is further preferred that the rotating disc or rotor be provided with a plurality of weighted shoes.

It is preferred that these shoes be provided in pairs diagonally opposed.

It is further preferred that these shoes be provided with a friction material bonded to their outer circumference.

The number of shoes is not restricted in this disclosure and the number of shoes and their required weight is governed by the spring motor torque provided for as standard.

It may also be preferred that springs be included to counter the normal gravitational forces if required, although this is not an essential feature of the disclosure.

It is preferred that when a rotational force is applied to this disc via the rotation of the reel spool, the shoes do not impede the normal low speed rotation of the device; however, once the speed begins to increase, the shoes are adapted to move radially outward from the center to apply an ever-increasing force upon the stator drum inner surface to slow the reel to a more acceptable rewind speed.

In order that the disclosure may be more readily understood, described herein, by way of non-limiting example, is a specific embodiment thereof with reference to the accompanying drawings.

DETAILED DESCRIPTION

Provided is a simple centrifugal braking device 20, 20*a*-20*c*, for use with spring motor hose reel assemblies.

Figure 1A:
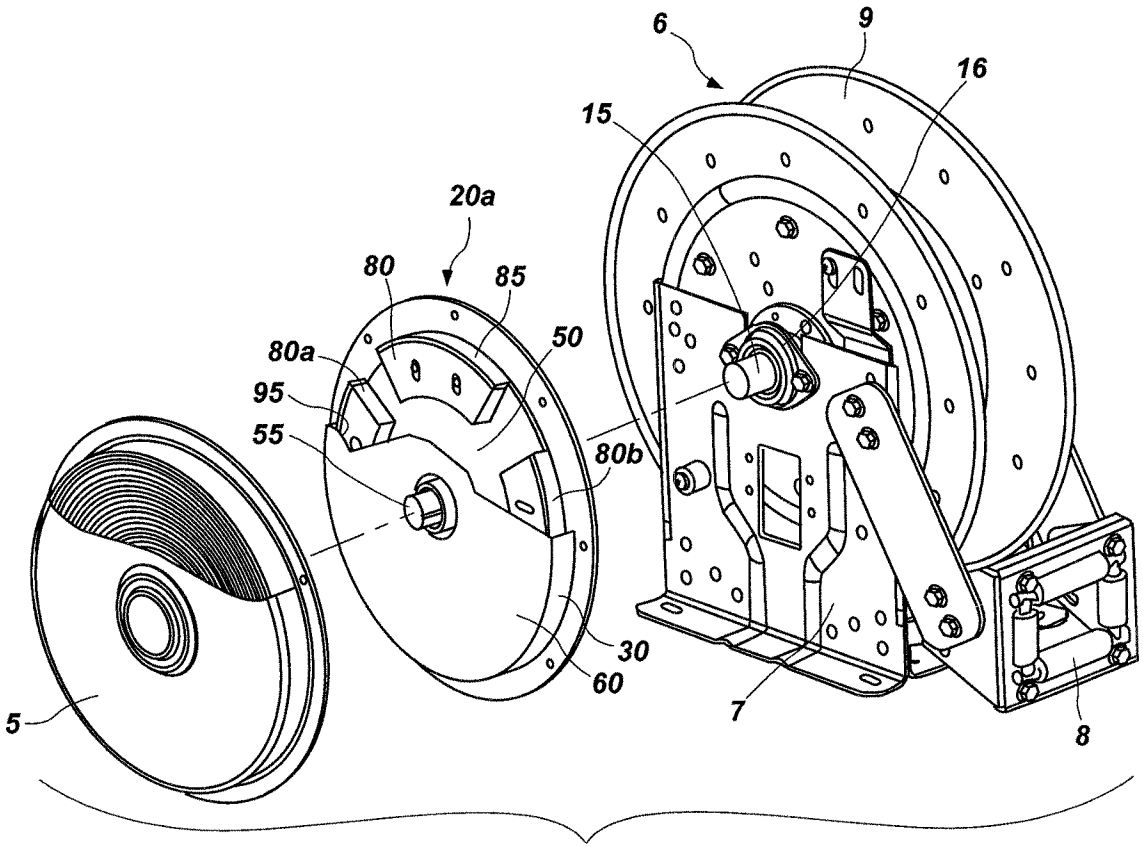
FIG. 1A shows an exploded diagram of the reel of the disclosure showing the assembly with one narrow brake cartridge.

The braking cartridge is a centrifugal braking device 20, which acts as a rewind speed control means for spring motor hose and cable reels 6 of the type shown in FIG. 1A. The braking device 20 is mounted on a hub shaft 15 via a hub bearing 16. The hub shaft 15 is associated with the reel 6 such that the braking device 20 controls the reel 6 rotational speed. The centrifugal braking device 20 comprises a drum 30 that comprises a stator 30 by which a rotating disc 50 is coupled to a brake device shaft 55, which is in line with the reel hub shaft 15 and is contained within the drum 30.

Figure 1B:
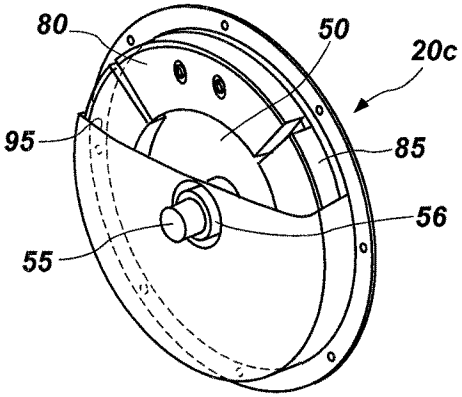
FIG. 1B shows a diagram of the wide brake cartridge.
Figures 1C, 3:
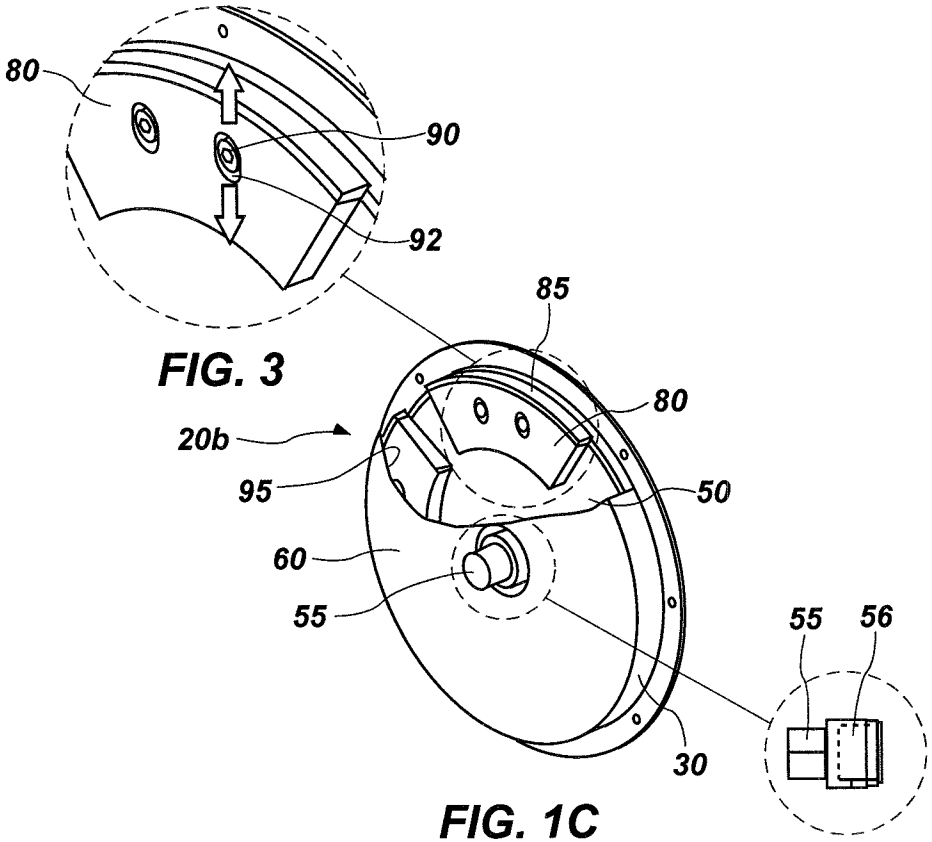
FIG. 1C shows a diagram of another narrow brake cartridge.
FIG. 3 shows a brake cartridge with shoes adapted to move radially.

The embodiment of the disclosure as shown in FIGS. 1A-1C utilize one or two braking cartridges 20*a*, 20*b*, each having a drum 30, preferably of similar dimensions to a coaxially mounted spring cartridge 5 for ease of integration should a unitary spring cartridge and brake cartridge assembly be required.

However, an embodiment comprising a unitary spring cartridge and brake cartridge assembly is not as preferred as the embodiment shown in FIGS. 1A-1C as the latter is able to be retrofitted to existing spring motor hose reel assemblies, such as a hose reel assembly 6 shown in FIG. 1A comprising the standard hose reel components of a support 7 for a hub shaft 15 and level winder 8, and spool 9 rotatably mounted on the hub shaft 15 via a bearing 16 mounted to the support 7. A plurality of brake devices 20*a*-20*b* may be used in association with the reel 6 and spring rewind motor 5. Each braking cartridge 20 has a hub shaft 55 adapted to engage with subsequent braking cartridges 20*a*-20*c*.

The drum 30 provides the stator 30 by which a rotating disc rotor 50 is coupled in line with a spring arbour and the hub shaft 15 and contained within the drum 30. Each braking cartridge 20 has a hub 55 adapted to engage with subsequent braking cartridges 20*a*-20*c*.

While this method of attachment is shown in this preferred embodiment, any preferred means could be used. For example, the braking cartridge 20 and spring cartridges 5 could be mounted on a single hub shaft.

Figures 2A, 2B, 2C:
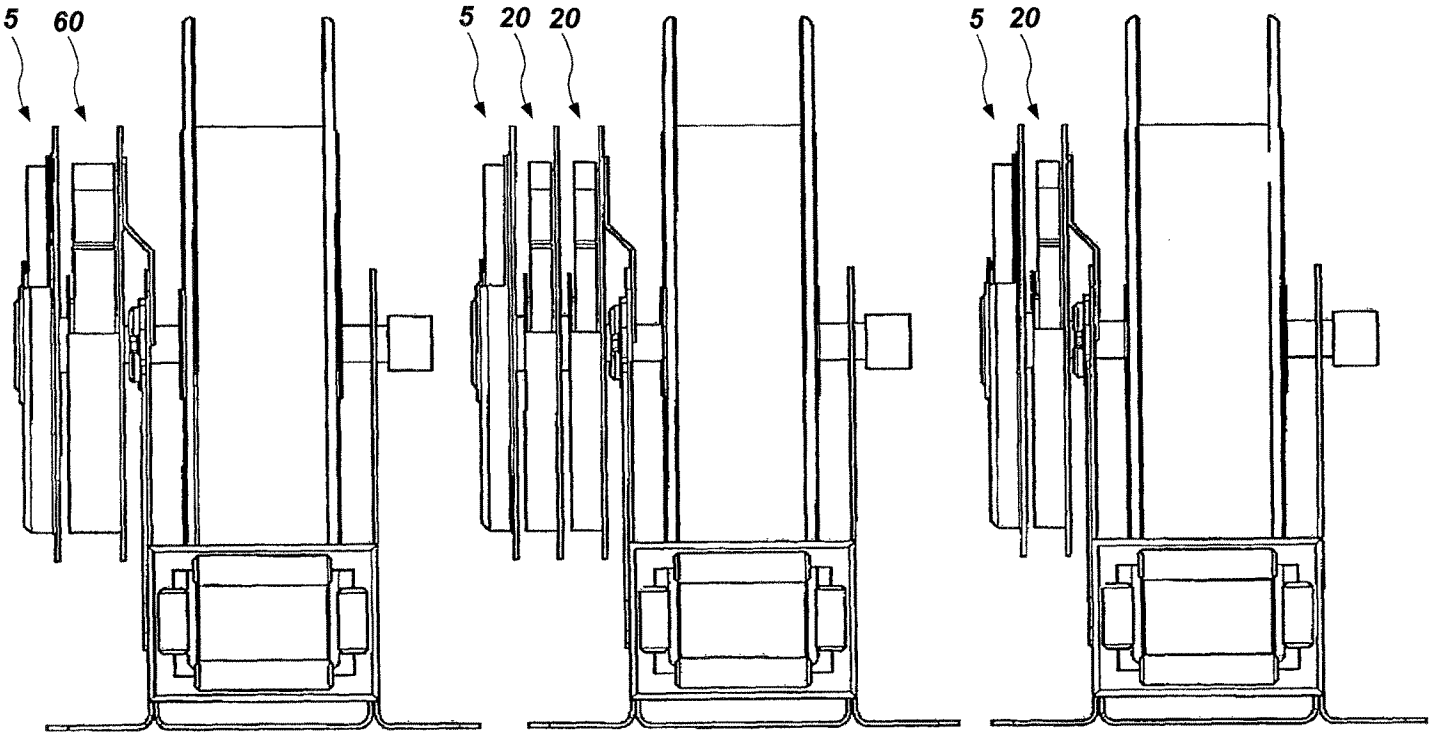
FIGS. 2A-2C show an end view of the disclosed device using (FIG. 2A) one wide brake cartridge, (FIG. 2B) two narrow brake cartridges, and (FIG. 2C) one narrow brake cartridge only.

By this means, as shown in FIG. 2A, a plurality of relatively narrow braking cartridges 60 may be used as opposed to a single wide cartridge 20*c* as shown in FIG. 1B. FIGS. 2A-2C show examples of these, each from an end view. The precise number of braking cartridges 20 used is not restricted in the disclosure and it is a simple matter to vary these.

The disc 50 of the braking cartridge 20 (and 60) is provided with a plurality of weighted shoes 80 in pairs, which are diagonally opposed, as shown in FIGS. 1A-1C. The outer circumference 85 of shoes 80 may be provided with a friction material.

The friction material may be bonded or may otherwise form a surface on their outer circumference 85.

FIG. 1C shows the second braking cartridge 20*b* in which the rotor disc 50 is provided on at least one face thereof with at least one of the pairs of shoes 80 diagonally opposed to one another and adapted to move radially upon rotation of the rotor disc 50. As shown in FIG. 1A with respect to the braking device 20*a* where one diagonally opposed pair of shoes 80*a*, 80*b* is shown, a plurality of shoe 80 pairs may be provided on the rotor disc 50.

The number of shoes 80 and their required weight is governed by the spring motor torque combination provided for as standard and is not restricted in the disclosure. Springs may or may not be included to counter the normal gravitational forces if required.

A rotational force may be applied to the rotor disc 50 via the rotation of the reel spool 9 causing the shoes 80 to move radially outward from the center of the rotor disc 50. This may apply an ever-increasing force upon an inner surface 95 of the stator drum 30 to slow the reel spool 9 to a more acceptable rewind speed.

Accordingly, when once at first a rotational force is applied to the disc 50 via the rotation of the reel spool 9, the shoes 80 do not impede the normal low-speed rotation of the device 9. Once the speed begins to increase, however, the centrifugal force due to the rotation, coupled with the mass of the shoes 80, causes the shoes 80 to move radially outward relative to the center of the disc 50. This radial movement of the shoes 80 is along sliding locators 90 formed on the rotor disc 50 face and located in shoe apertures 92. The friction material of outer circumference 85 of shoes 80 to make contact with the inside rim 95 of the stator drum 30 to slow the reel spool 9 to a more acceptable rewind speed.

By this means, the shoes 80 apply an ever-increasing force on the face of the inside rim 95 of the drum 30 to slow the rotation of the reel spool 9 to a more controlled and acceptable rewind speed.

The precise means whereby the shoes 80 are attached to the disc 50 and move radially is not restricted in the disclosure.

The braking device 20 of the disclosure can be either retrofitted to existing spring motor rewind hose reel systems 6 or can form part of a new reel design.

Due to the fact that the type of centrifugal speed governors that are readily available require a relatively high rotational speed to function, and that typically the rotational speed of the hose reel spool 9 can be described as relatively very slow, despite the fact that such very slow speeds might still pose a high risk to operators of the reel 6, then the centrifugal brake device 20 has been specially developed to function at the very low rotational speeds of the reel 6 and this, in itself, makes the braking device 20 of the disclosure unique in relation to hose reel braking.

As shown in FIGS. 2A-2C, the drum 30 may be a single drum assembly 60 dimensioned to accommodate a spring motor as well as a rotor disc.

While we have described herein one specific embodiment of the disclosure, it is envisaged that other embodiments of the disclosure will exhibit any number and combination of the features previously described and it is to be understood that variations and modifications of this can be made without departing from the spirit and scope of the disclosure.

The claims defining the invention are as follows:

1. A spring motor reel comprising:

a spring motor cartridge for rewinding the spring motor reel, and a hub shaft upon which are mounted multiple brake cartridges in association with the spring motor cartridge, wherein each brake cartridge comprises:

a centrifugal braking device comprising brake shoes provided on a rotor disc, the brake shoes adapted to move radially outwards on the rotor disc as the rotor disc rotates under action of the spring motor cartridge whereby the brake shoes may engage against an inner rim of the brake cartridge to slow rotation of the spring motor reel, and a hub extending from each brake cartridge adapted to engage with a subsequent brake cartridge.

2. The spring motor reel of claim 1, wherein each of the brake cartridges has dimensions approximating those of the spring motor cartridge.

3. The spring motor reel of claim 2, wherein the rotor disc has locators adapted to move radially upon rotation of the the disc rotor.

4. The spring motor reel of claim 1, wherein the rotor disc has locators adapted to move radially upon rotation of the the disc rotor.

5. The spring motor reel of claim 4, wherein each of the brake cartridges has dimensions approximating those of the spring motor cartridge.

6. The spring motor reel of claim 1, wherein the brake shoes are provided with a friction material bonded or otherwise forming a surface on the brake shoes' outer circumference.

7. The spring motor reel of claim 1, wherein the brake shoes are provided in one or more diagonally opposed pairs in each of the brake cartridges.

* * * * *